US008011703B2

(12) United States Patent
Newman et al.

(10) Patent No.: US 8,011,703 B2
(45) Date of Patent: Sep. 6, 2011

(54) LEVER HANDLE DOOR FURNITURE

(75) Inventors: Donald John Newman, Hampton Park (AU); Robert John Watson, East Melbourne (AU)

(73) Assignee: Assa Abloy Australia Pty Limited, Oakleigh, Victoria (AU)

( * ) Notice: Subject to any disclaimer, the term of this patent is extended or adjusted under 35 U.S.C. 154(b) by 878 days.

(21) Appl. No.: 10/597,814

(22) PCT Filed: Feb. 8, 2005

(86) PCT No.: PCT/AU2005/000152

§ 371 (c)(1), (2), (4) Date: Dec. 5, 2006

(87) PCT Pub. No.: WO2005/080713

PCT Pub. Date: Sep. 1, 2005

(65) Prior Publication Data

US 2007/0176436 A1 Aug. 2, 2007

(30) Foreign Application Priority Data

Feb. 24, 2004 (AU) ..... 2004900899

(51) Int. Cl.
*E05B 1/00* (2006.01)
*E05B 3/00* (2006.01)

(52) U.S. Cl. ..... 292/347; 292/348; 292/DIG. 61; 70/224

(58) Field of Classification Search ..... 292/347, 292/336.3, 348, DIG. 61; 70/224
See application file for complete search history.

(56) References Cited

U.S. PATENT DOCUMENTS

| | | | | |
|---|---|---|---|---|
| 2,216,467 | A * | 10/1940 | Falk | 292/347 |
| 5,067,758 | A | 11/1991 | Fann et al. | |
| 5,322,333 | A | 6/1994 | Norton, II et al. | |
| 5,617,749 | A * | 4/1997 | Park | 70/224 |
| 5,813,708 | A * | 9/1998 | Shen | 292/165 |
| 5,934,117 | A * | 8/1999 | Shen | 70/224 |
| 5,941,108 | A * | 8/1999 | Shen | 70/467 |
| 6,141,998 | A | 11/2000 | Seo | |
| 6,386,602 | B1 * | 5/2002 | Lan | 292/336.3 |
| 6,584,816 | B1 * | 7/2003 | Lee | 70/224 |

FOREIGN PATENT DOCUMENTS

| | | |
|---|---|---|
| DE | 29819917 | 1/1999 |
| WO | WO 8802429 | 4/1988 |

* cited by examiner

*Primary Examiner* — Carlos Lugo
(74) *Attorney, Agent, or Firm* — Kirton & McConkie; Michael F. Krieger

(57) ABSTRACT

A handle assembly has a handle, a handle spigot to which the handle is attached, a biasing member to bias the handle to a naturally closed position, an operating plate which is rotatable by the handle spigot, a mounting stock, and a housing, the spigot, the biasing member, operating plate and a majority of the mounting stock being positioned within the housing, the mounting stock being securable to the housing to hold all the components within the housing. In this manner, the handle assembly can be made as a "complete" unit with all the internal components being in position and with the handle being rotatably attached relative to the housing. Thus, no separate rose is required. Another advantage is that the unit can be assembled using a substantially concealed fixing arrangement to improve security and also to improve the aesthetic appeal of the assembly.

15 Claims, 3 Drawing Sheets

LEVER HANDLE DOOR FURNITURE

FIELD OF THE INVENTION

This invention is directed to a lever handle door furniture assembly and is particularly directed to a concealed type assembly which can do away with the need for a rose. The invention will be described with reference to door furniture but it should be appreciated that no particular limitation is meant thereby and the invention can also be used with window furniture and the like.

BACKGROUND ART

Door furniture conventionally comprises a handle. The handle can be rotated or turned between an open position and a closed position. The handle is usually spring biased back to the naturally closed position. Various components are required in the door furniture, and to provide a visually appealing look, one of the components is typically a rose which is a cover member which is screwed to the door. The cover member hides from view the various components of the door furniture. The handle is mounted for rotation relative to the cover member. The rose also functions to hide and cover the opening that is cut through the door to enable the handle to ultimately manipulate the latch tongue. The rose is usually formed of metal and can be quite decorative and is typically circular in configuration.

However, there would be an advantage if a lock assembly could be provided which does not have a rose which is attached to the door. One reason for this may be to facilitate removal of some of the lock components (for instance to change the lever handle). Another reason is to provide a more modern look to the door furniture. Another reason may be to simplify assembly and disassembly of the door furniture.

Another disadvantage with door furniture is that the furniture components may require substantial modification depending on whether the door furniture is to be used on a mortise lock, a tubular latch or other types of locks or latches. Therefore, there would be an advantage if door furniture could be provided which would make this more straightforward.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide door furniture that may overcome at least some of the above-mentioned disadvantages or provide the public with a useful or commercial choice.

In one form, the invention resides in a handle assembly, the handle assembly comprising a handle, a handle spigot to which the handle can be attached, biasing means to bias the handle to a naturally closed position, an operating plate which is rotatable by the handle spigot, a mounting stock, and a housing, the spigot, biasing means, operating plate and a majority of the mounting stock being positioned within the housing, the mounting stock being securable to the housing to hold all said the components within the housing.

In this manner, the handle assembly can be made as a "complete" unit with all the internal components being in position and with the handle being rotatably attached relative to the housing. Thus, no separate rose is required. Another advantage is that the unit can be assembled using a substantially concealed fixing arrangement to improve security and also to improve the aesthetic appeal of the assembly.

The handle assembly can be fitted to a mortise lock or to a tubular latch (or other type of lock or latch) with little or no modification to the handle assembly. However, it may be necessary to provide an adaptor or additional fitting. For instance a mounting plate may be required to enable the handle assembly to be fitted to a mortise lock, and it may be necessary to provide a mounting adapter to enable the handle assembly to be fitted to a tubular latch. These additional components can be fitted to the handle assembly and therefore the assembly itself does not require major modification.

The handle will typically comprise a lever handle which may be of any suitable shape and size and may comprise a left-hand or right-hand lever handle.

The handle spigot will typically comprise a head portion and an elongate tail portion. The head portion may be designed to fit with or to fit to the handle. Typically, the head portion will be angled and will fit within a suitable socket or recess in the handle. For instance, the head portion may comprise a hexagonal shape. The tail portion may be substantially tubular or cylindrical in configuration and will typically have a length of between 10-100 millimeters and a diameter of between 4-20 millimeters. No particular limitation however is meant thereby. The tail portion will typically have an internal configuration to engage with a spindle which will typically comprise a square or rectangular cross-section, this type of spindle being quite conventional. The tail portion will typically be provided with engagement means to engage with or to the operating plate. Typically, the tail portion will have a slot/groove/recess to engage with a projection on the operating plate. However, the opposite arrangement may also be convenient, that is, where the tail portion is provided with a projection and the operating plate is provided with a corresponding slot/groove/recess.

The handle assembly will have a biasing means to bias the handle to a naturally closed position. The biasing means may comprise a spring. The spring will typically be a helical spring. The spring will typically extend about the tail portion of the handle spigot and will have means to engage with a stop provided in the housing and engagement means provided on the operating plate to bias the spigot (and therefore the handle) to a naturally closed position.

The handle assembly will typically include a mounting plate. The mounting plate may comprise a disk like member and may be formed with a central opening containing engagement means to engage with the handle spigot.

The handle assembly is provided with a mounting stock. The mounting stock may comprise an end member which at least partially passes into the housing. The mounting stock may be provided with at least one fixture opening to enable the mounting stock to be secured to a mortise lock, a tubular latch or other member. Suitably, a plurality of such fixture openings is provided. A fixture (typically a screw such as a grub screw) can pass through the, or each opening. A nut (typically a long nut) can be provided to engage with the screw to secure the mounting stock and allow for varying door thicknesses.

The handle assembly further comprises a housing. The housing may comprise a substantially hollow cylindrical barrel. The barrel may have an inner end which is substantially open and an outer end which is formed with a bore. The inner end may fit over the mounting stock, and the handle spigot may partially pass through the bore in the outer end. Suitably, the housing is attached to the mounting stock and this may be done by any convenient means including the use of a fastener.

In another form, the invention resides in a handle assembly that can be attached to a lock or to a latch in a manner by which the attachment fixtures are not easily accessible. Suitably, the handle assembly comprises a handle mechanism, and a mounting member, the mounting member being attached to the lock or latch or replacing part of the lock or latch, and the handle mechanism being securable to the mounting member. The mounting member may comprise a mounting plate or a mounting adapter similar to that described above. The attachment fixtures typically comprise screws.

BRIEF DESCRIPTION OF THE DRAWINGS

An embodiment of the invention will be described with reference to the following drawings in which.

BEST MODE

Figure 1:
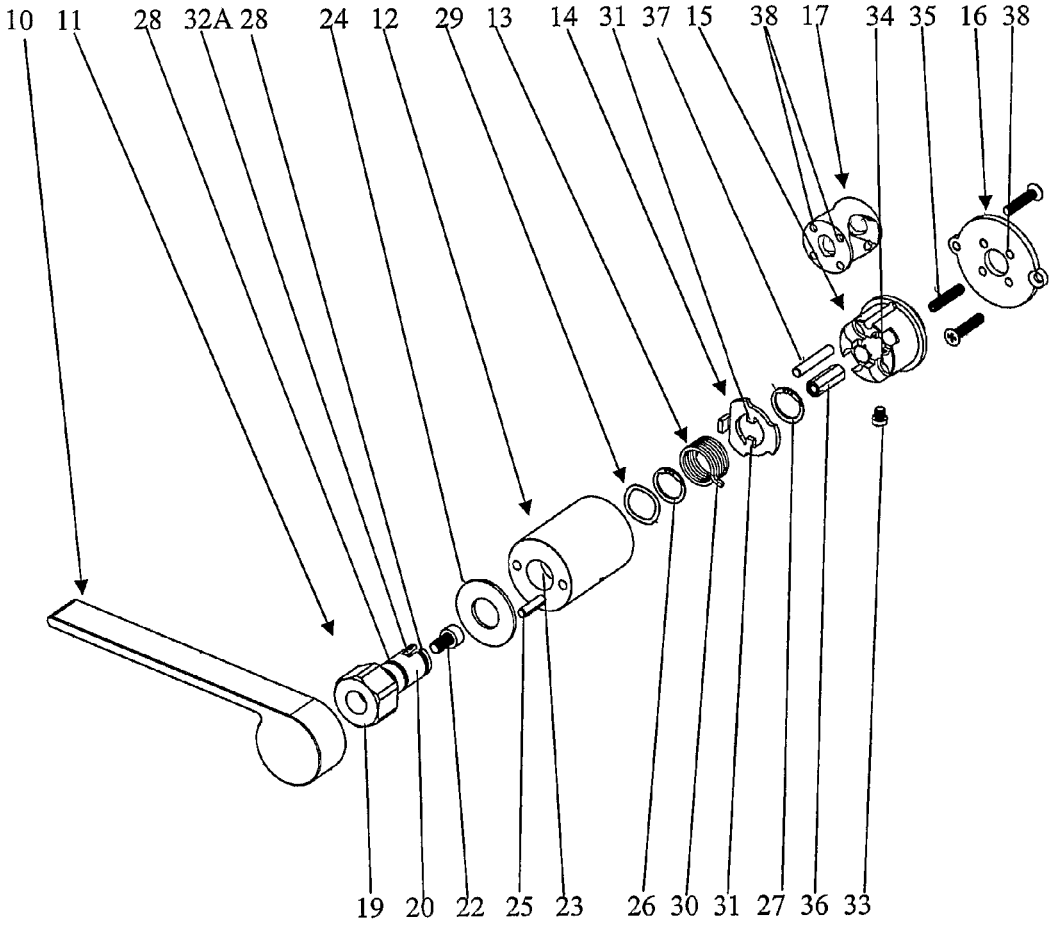
FIG. 1. Illustrates an exploded view of a handle assembly and illustrates a mounting plate and a mounting adaptor.

Referring initially to FIG. 1, there is illustrated the major components of the handle assembly which comprise a lever handle 10, a handle spigot 11, a housing 12, biasing means in the form of a spring 13, an operating plate 14 and a mounting stock 15. These are the principal components of the handle assembly. The handle assembly can be mounted to a mortise lock (not illustrated) or to a tubular latch (not illustrated). If the handle assembly is mounted to a mortise lock, a mounting plate 16 is provided and this will be described in greater detail below. Conversely, if the handle assembly is attached to a tubular latch, a mounting adapter 17 is provided (instead of mounting plate 16) and this will be described in greater detail below.

Figure 2:
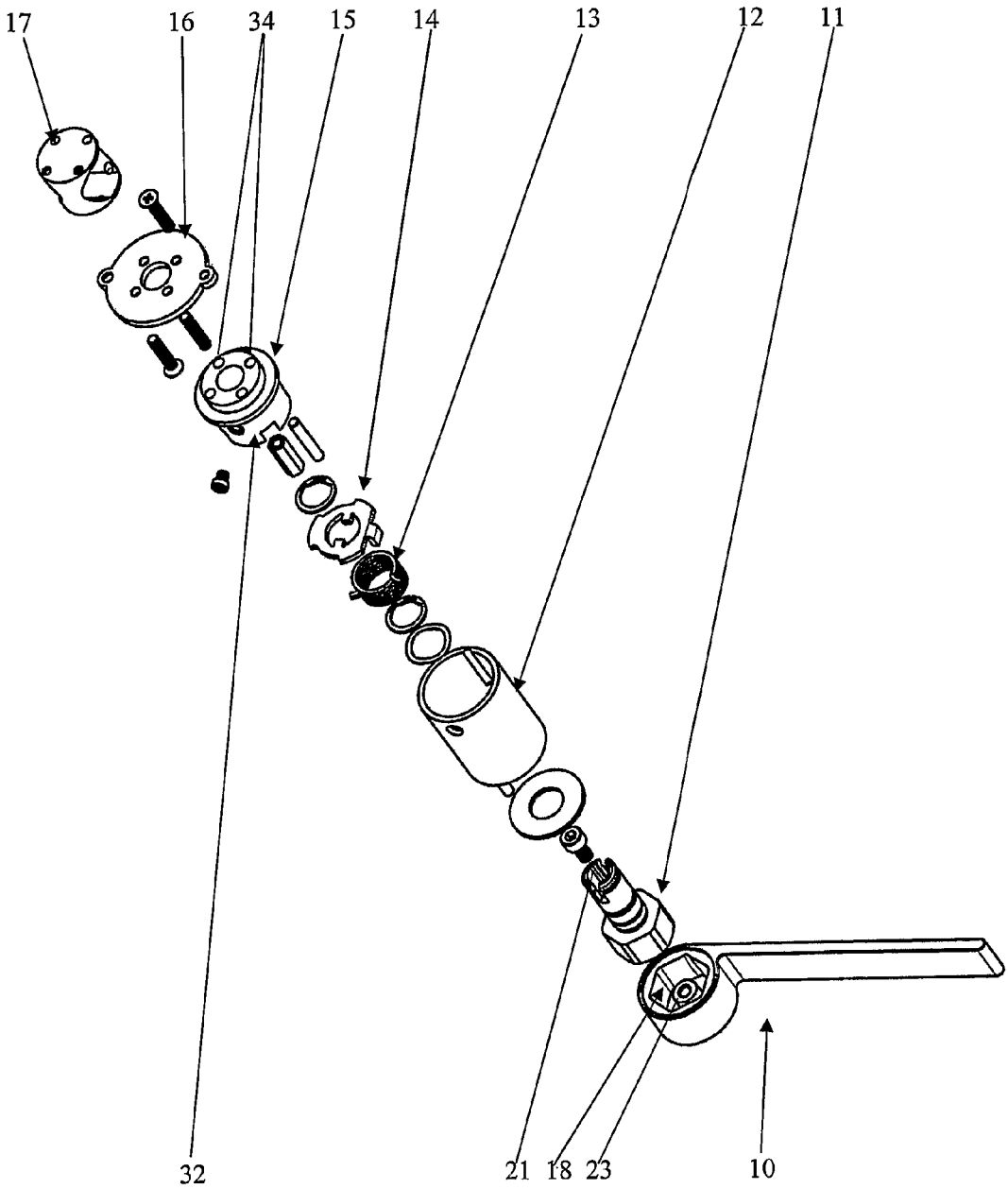
FIG. 2. Illustrates the handle assembly from the other side.

Referring now in greater detail to the various components, lever handle 10 can be made of brass and is provided with an internal hexagonal recess 18 best illustrated in FIG. 2.

Handle spigot 11 can be made of brass and comprises a head portion 19 which is hexagonal and which fits within recess 18 to mount lever handle 10 onto spigot 11. Handle spigot 11 further comprises an elongate tail portion 20 which is cylindrical and which is provided with an internal recess 21 (best illustrated in FIG. 2). Recess 21 accommodates one end of a conventional type of spindle (not illustrated) which typically comprises an elongate square bar. The spindle ultimately operates the mortise lock tongue or the tubular latch which is known. Spigot 11 is screwed to lever handle 10 via a small screw 22 which engages with a threaded recess 23 which is inside recess 18 in the lever handle (this being best illustrated in FIG. 2).

The cylindrical tail portion 20 passes through a bore 23 in one end of housing 12. Housing 12 is substantially hollow. A nylon washer 24 sits between housing 12 and head portion 19 of spigot 11 and is spaced away from housing 12 by a roll pin spring stop 25. Housing 12 can be made of brass.

Spring 13 extends about tail portion 20. Spring 13 is held in place by a pair of circlips being a forward circlip 26 and a rear circlip 27. Circlip 26 secures spigot 11 (and therefore lever handle to the housing 12. These circlips extend into corresponding annular recesses 28 on the tail portion 20. A wave washer 29 sits in front of circlip 26. The spring 13 contains two outwardly extending portions 30 which abut against part of the assembly to enable the spring to bias lever handle 10 into the naturally closed position. This arrangement is quite known.

Operating plate 14 is positioned about tail portion 20 of handle spigot 11. Operating plate 14 has an internal aperture to enable it to pass over the end of tail portion 20. The internal aperture is provided with a pair of inwardly extending abutments 31 which engage in corresponding recesses 32A on tail portion 20. Thus, rotation of handle spigot 11 causes rotation of operating plate 14. Circlip 27 sits behind operating plate 14 to lock the operating plate and the spring to handle spigot 11.

Figure 3:
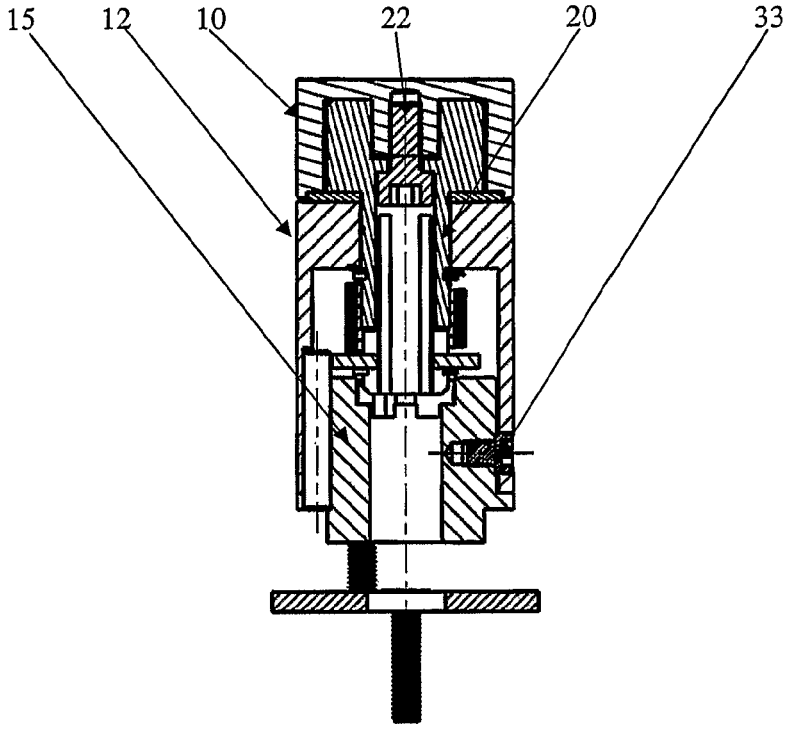
FIG. 3. Illustrates a section view of an assembled handle assembly.
Figure 4:
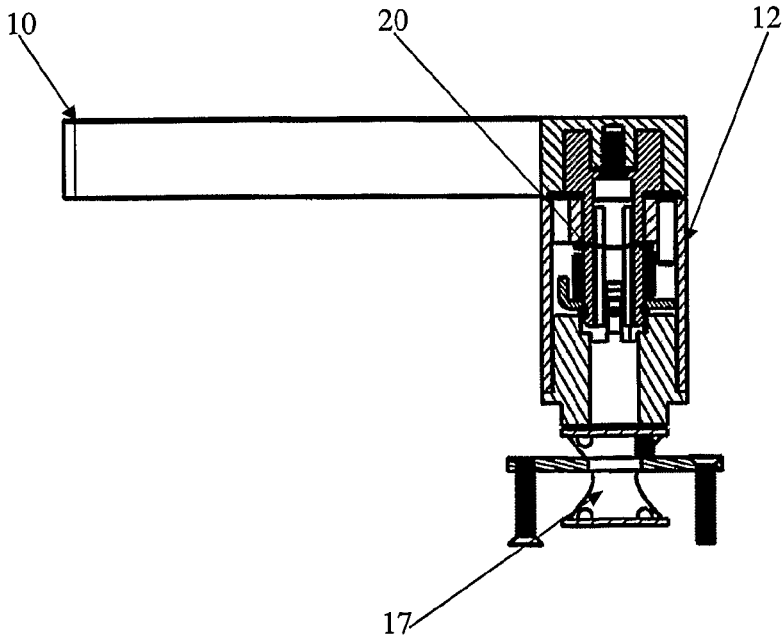
FIG. 4. Illustrates another section view of the assembled handle assembly.

This entire arrangement is positioned within housing 12 this being illustrated in FIG. 3 and FIG. 4.

The handle assembly is fitted to a mortise lock/tubular latch etc as follows: if the assembly is to be fitted to a mortise lock, a mounting plate 16 is provided. Mounting plate 16 is attached to the side face of the mortise lock and the mortise lock will typically have a shallow recess to fit the mounting plate to the mortise lock in a flush manner. Mounting plate 16 contains a number of threaded openings 38. Long screws 35 are screwed into these threaded openings and the screws pass through an opening in the side of the door/window. For most mortise locks there will be a mounting plate on each side of the lock although this need not be essential.

A mounting stock 15 is then attached relative to mounting plate 16 via the long screws 35. The mounting stock 15 is positioned on the side of a door/window. Mounting stock 15 contains a number of openings 34 to enable the screws 35 to pass through the openings. Long nuts 36 are threaded to the other end of screws 35 and can be tightened to clamp the mounting stock 15 against the side of the door/window. By having long screws 35, the mounting stock can be mounted to doors/windows of different thicknesses.

Mounting stock 15 fits within the open end of housing 12, and a retaining screw 33 is used to attach the housing to mounting stock 15.

If the assembly is to be fitted to a tubular latch, mounting plate 16 is not used and instead a mounting adapter 17 is used. Adapter 17 again contains a number of threaded openings into which long screws can be threaded and mounting stock 15 can be attached via the screws to the side of the door. No change is required to the design of the mounting stock.

The handle assembly has a relatively concealed fixing as the handle assembly is attached to a mortise lock or tubular latch using for long screws and long nuts that are not accessible once the remainder of the handle assembly has been fitted. Only a single small retainer screw 33 is used to attach housing 12 to the mounting stock 15. Also, a rose is not required or is a very discreet size (that is the rose can comprise housing 12) to provide a "minimalist" look to the handle assembly. The lever can be exchanged with minimum disassembly of the mechanism.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A handle assembly comprising a handle, a handle spigot to which the handle is attached, a biasing member to bias the handle to a naturally closed position, an operating plate which is rotatable by the handle spigot, a mounting stock, and a housing comprising a closed end with a bore therethrough and an open end, the bore being adapted to receive a portion of the spigot which is secured inside the closed end by a first fastener, and which and the open end being adapted to receive therein and be secured to the mounting stock by a second fastener, the biasing member, operating plate and portions of the mounting stock and the spigot being positioned within the housing once the housing is fitted to the mounting stock, and wherein the handle is secured to the mounting stock through engagement of the housing with the mounting stock.

2. The handle assembly as claimed in claim 1, wherein the handle comprises a lever handle that may be a left-hand lever handle or a right-hand lever handle.

3. The handle assembly as claimed in claim 1, wherein the handle spigot comprises a head portion and an elongate tail portion, the head portion adapted to fit to the handle.

4. The handle assembly as claimed in claim 3, wherein the head portion is angled and fits within a socket or recess in the handle.

5. The handle assembly as claimed in claim 3, the tail portion is substantially tubular or cylindrical in configuration and has a length of between 10-100 millimeters and a diameter of between 4-20 millimeters, and has an internal configuration to engage with a conventional spindle.

6. The handle assembly as claimed in claim 5, wherein the tail portion is provided with engagement means to engage with or to the operating plate.

7. The handle assembly as claimed in claim 6, wherein the tail portion has a slot/groove/recess to engage with a projection on the operating plate, or the tail portion is provided with a projection and the operating plate is provided with a corresponding slot/groove/recess.

8. The handle assembly as claimed in claim 3, wherein the biasing member comprises a spring which extends about the tail portion of the handle spigot and has means to engage with a stop provided in the housing and engagement means provided on the operating plate to bias the spigot and therefore the handle to a naturally closed position.

9. The handle assembly as claimed in claim 1, including a mounting plate which comprises a disk like member formed with a central opening containing engagement means to engage with the handle spigot.

10. The handle assembly as claimed in claim 1, wherein the mounting stock comprises an end member which at least partially passes into the housing.

11. The handle assembly as claimed in claim 10, wherein the mounting stock is provided with at least one fixture opening to enable the mounting stock to be secured to a mortise lock, a tubular latch or another locking or latching member.

12. The handle assembly as claimed in claim 1, wherein the housing comprises a substantially hollow cylindrical barrel which has an inner end which is substantially open and an outer end which is formed with a bore, whereby the inner end, in use, fits over the mounting stock, and the handle spigot passes at least partially through the bore in the outer end, the housing being attached to the mounting stock.

13. A lock or latch including a handle assembly as claimed in claim 1.

14. A handle assembly including a handle, a housing comprising a closed end with a bore therethrough and an opposite open end and a mounting stock, a handle spigot to which the handle is attached, which secures the handle to the closed end of the housing by passing through the bore and being secured by a first fastener inside the housing; a biasing member which is associated with the handle spigot and with the housing and which biases the handle to a naturally closed position relative to the housing, an operating plate which is rotatable by the handle spigot relative to the housing, and the housing can be secured to the mounting stock by fitting the housing to the mounting stock so that the mounting stock extends at least partly into the open end of the housing which opposes the end which is adjacent the handle and is secured by a second fastener, the biasing member and the operating plate being positioned within the housing, and wherein the handle can be disengaged from the mounting stock by detaching the housing from the mounting stock.

15. A handle assembly comprising a handle, a handle spigot to which the handle is attached, a biasing member to bias the handle to a naturally closed position, an operating plate which is rotatable by the handle spigot, a mounting stock, and a housing having a bore at one end through which a tail end of the handle spigot is passed and secured by a first fastener and the housing having an opposed open end adapted to receive and be attached to the mounting stock by a second fastener, the biasing member, operating plate and portions of the mounting stock and the spigot being positioned within the housing once the housing is fitted to the mounting stock, and wherein the handle is secured to the mounting stock through engagement of the housing with the mounting stock.

* * * * *